United States Patent [19]

Focke et al.

[11] Patent Number: 5,014,490

[45] Date of Patent: May 14, 1991

[54] APPARATUS FOR THE FEEDING OF PACKAGING BLANKS TO A FOLDING UNIT

[75] Inventors: Heinz Focke, Verden; Jürgen Wach, Bremen, both of Fed. Rep. of Germany

[73] Assignee: Focke & Co. (GmbH & Co.), Fed. Rep. of Germany

[21] Appl. No.: 409,905

[22] Filed: Sep. 20, 1989

[30] Foreign Application Priority Data

Sep. 24, 1988 [DE] Fed. Rep. of Germany ..... 3832533

[51] Int. Cl.[5] ..... B65B 57/12

[52] U.S. Cl. ..... 53/73; 53/234; 53/389.1

[58] Field of Search ..... 53/73, 389, 234; 83/304

[56] References Cited

U.S. PATENT DOCUMENTS

| | | | |
|---|---|---|---|
| 4,075,816 | 2/1978 | Holt et al. | 53/389 X |
| 4,114,355 | 9/1978 | Davies et al. | 53/389 |
| 4,218,943 | 8/1980 | Osburg | 83/304 |
| 4,711,065 | 12/1987 | Focke et al. | 53/239 X |
| 4,885,895 | 12/1989 | Focke | 53/73 |

FOREIGN PATENT DOCUMENTS

| | | | |
|---|---|---|---|
| 3721459 | 1/1989 | Fed. Rep. of Germany . | |
| 2000712 | 1/1979 | United Kingdom | 83/304 |

*Primary Examiner*—John Sipos

*Attorney, Agent, or Firm*—Sughrue, Mion, Zinn, Macpeak & Seas

[57] ABSTRACT

Apparatus for the feeding of packaging blanks to a folding unit. In the production of (film) packs, especially for stacks of paper handkerchiefs, blanks are severed from a continuously supplied web of material and fed to a folding member, especially a folding turret (11) for wrapping the paper handkerchiefs and folding the blank (10). When there is a momentary interruption in the feed of articles to be wrapped to the folding turret (11), the production and conveyance of blanks (10) are also to be interrupted. For this purpose, a fixedly located counter knife (22) of a severing station (16) is temporarily movable out of the operative or cutting position, so that, despite the fact that a knife roller (21) with cutting knives (23, 24) continues to run, a severing cut is not made in the stationary web of material (12). For this purpose, a support for the counter knife (22) is equipped with an adjusting mechanism acting in a pulsatory manner. The arrangement and actuation of the knives, especially the movement of the counter knife in order to interrupt the blank production, make it possible to achieve extremely rapid and accurate operating cycles.

11 Claims, 5 Drawing Sheets

APPARATUS FOR THE FEEDING OF PACKAGING BLANKS TO A FOLDING UNIT

BACKGROUND OF THE INVENTION

The invention relates to an apparatus for the feeding of blanks of packaging material to a folding unit (folding turret) for the packaging of articles or groups of articles, the blanks being severable from a continuous web of material by interacting knives (rotating severing knives, stationary counter knives) and being feedable to the folding turret, and with a drive for the web of material, especially with draw rollers.

In the packaging of articles into blanks severed from a web of material, in the region of a folding turret or the like, there is the problem of feeding the blanks, whilst at the same time temporarily interrupting the conveyance of articles. U.S. Pat. No. 4,885,895 provides a process and an apparatus for the feeding of packaging blanks to a folding unit, and in these the production and therefore also the feeding of blanks to the folding turret are interrupted when and as long as articles, especially stacks of paper handkerchiefs, are not supplied to the folding turret. The apparatus of this older problem solution is designed in such a way that knives are arranged on two oppositely rotating knife rollers. On one of these knife rollers, the severing knives are adjustable, in such a way that, for the temporary interruption of the blank production, they are moved out of cutting engagement, specifically as a result of the pivoting of the pivotably mounted severing knives.

SUMMARY OF THE INVENTION

The object on which the invention is based is to provide an improved alternative to the apparatus according to the above U.S. Pat. No. 4,885,895, which, in particular, responds more quickly in the event of an interruption in the conveyance of articles and which, by small reliable adjusting movements of knives, immediately prevents the production of blanks.

To achieve this object, the apparatus according to the invention is characterized by a rotating knife roller with at least one severing knife and by a stationary counter knife, in the absence of a feed of articles the counter knife being movable out of engagement with the severing knife of the rotating knife roller.

It has proved simpler and more reliable if a stationary (counter) knife is made adjustable, in order temporarily to prevent the production of blanks.

According to a further proposal of the invention, the counter knife is attached to a knife arm which is pivotable by means of an adjusting mechanism, especially by means of an eccentric mechanism, and which brings the counter knife out of engagement as a result of the pivoting movement.

According to the invention, the adjusting movements of the counter knife are dependent on the movement of the constantly rotating knife roller. This is equipped with a cam disc for controlling the movement of an adjusting member for the knife arm or for the eccentric mechanism.

Further features of the invention relate to the arrangement of the counter knife and to the arrangement and design of the eccentric mechanism with the adjusting member.

BRIEF DESCRIPTION OF THE DRAWINGS

An exemplary embodiment of the invention is explained in detail below by means of the drawings. In these.

DETAILED DESCRIPTION OF THE PREFERRED EMBODIMENTS

Figure 1:
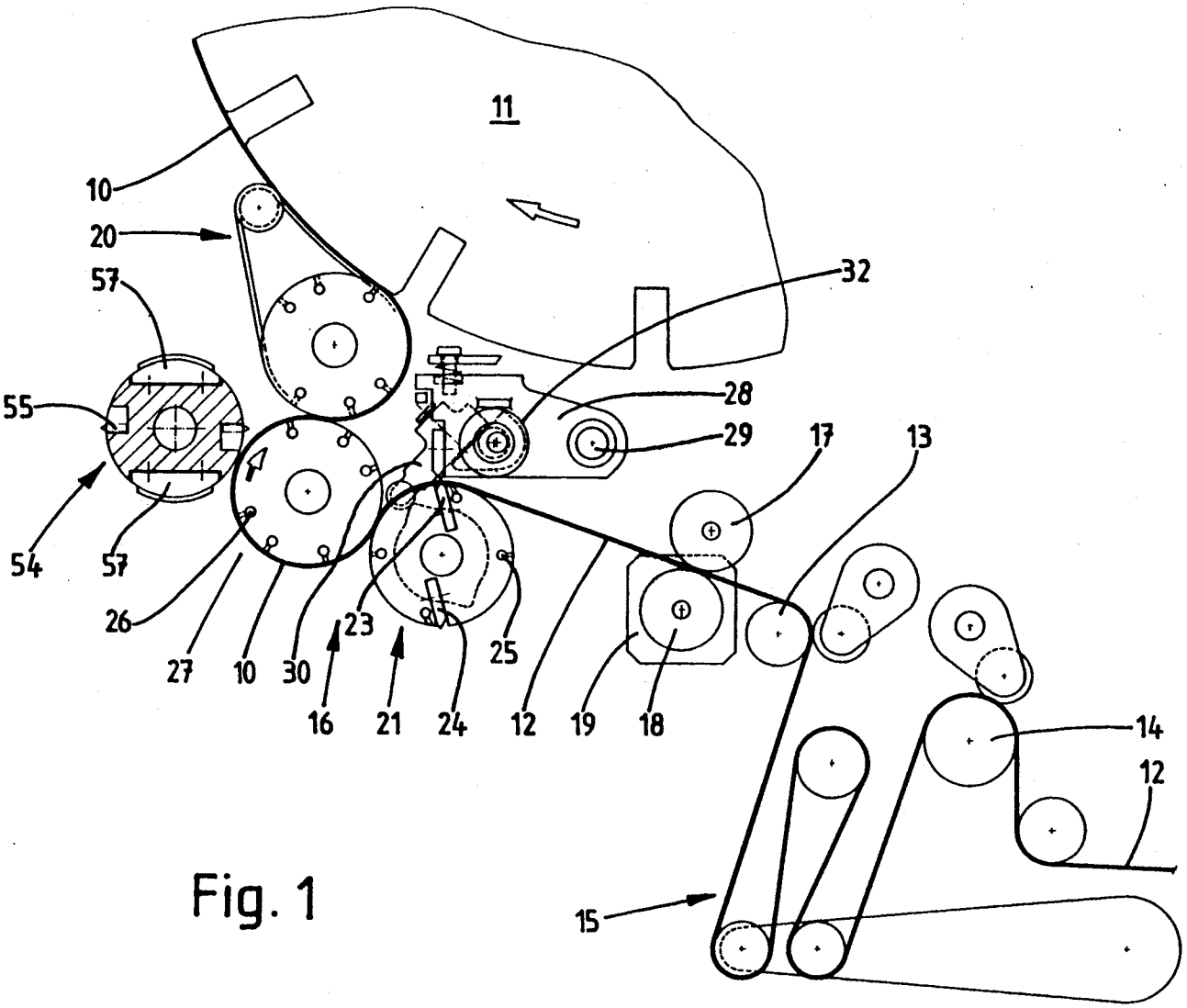
FIG. 1 shows a side view of a cutout from an apparatus for the packaging of articles.

The exemplary embodiment illustrated relates to the packaging of stacks of paper handkerchiefs, but also other articles. These are to be wrapped in a blank 10 made of film material, for example a PE film. The packaging material or the blank 10 is conveyed along the circumference of a folding turret 11, in the region of which the articles are wrapped in the blank 10 and the latter is folded. The design and mode of operation of the folding turret 11 emerge from DE-A-37 01 273.8.

The blanks 10 are severed successively from a web of material 12 preferably conveyed continuously. This is drawn off from a reel (not shown) and, via deflecting rollers 13, 14 and a double rocker 15 for compensating variations of movement, conveyed to a severing station 16 for severing the blanks 10. In the region of the severing station 16, the web of material 12 is conveyed at an essentially constant speed. For this purpose, the severing station 16 is preceded by a pair of interacting draw rollers 17, 18. At least one of these draw rollers 17, 18 is driven by a stepping motor 19 which ensures an accurate advance of the web of material 12, so that exact portions corresponding to a blank length can be conveyed.

The blanks 10 produced in the region of the severing station 16 are guided up against the circumference of the folding turret 11 by a transfer conveyor 20.

The above-described details of the apparatus correspond in terms of design and functioning to the apparatus according to U.S. Pat. No. 4,885,895. As in the abovementioned patent, the severing station 16 is to be designed so that the production and therefore the feed of blanks 10 to the folding turret 11 are interrupted temporarily, particularly when no articles (handkerchief stacks) to be wrapped are supplied. For this purpose, as in the older patent mentioned, the severing station 16 is designed so that, during this phase, cutting members of the severing station 16 continue to run, but the cutting function is interrupted and the web of material 12 halted.

The severing station 16 is essentially formed by a continuously rotating knife roller 21 and by a stationary or fixedly located counter knife 22. In the exemplary embodiment illustrated, the knife roller 21 is designed with two cutting knives 23, 24 located diametrically opposite one another. As is generally customary, these are arranged in such a way that they project with their cutting edge slightly above the circumference of the knife roller 21. A severing cut is thereby made by the particular appropriately positioned counter knife 22 in the web of material 12 running through between the cutting knife 23, 24 on the one hand and the counter knife 22 on the other hand. The knife roller 21 is designed as a suction roller with conventional suction bores 25. These guarantee that the web of material 12 is laid exactly against the circumference of the knife roller 21. Furthermore, it is provided that the knife roller 21 acts as a conveying member for the web of material 12 or the blank 10 which is transferred to an intermediate conveyor roller 27 likewise designed as a suction roller with suction bores 26. The blank 10 is conveyed further from this to the transfer conveyor 20.

When there is a momentary absence of feed of articles to be wrapped, a corresponding signal is generated (see the older U.S. Pat. No. 4,885,895), and this ensures that, after a severing cut has been made, the web of material 12 is conveyed further by the amount of a portion which is less than the length of a blank 10. The draw rollers 17, 18 are accordingly driven and stopped.

Furthermore, the functioning of the cutting members is interrupted, but nevertheless with the knife roller 21 rotating further and the following conveying members likewise being moved further. Here, the cutting function is interrupted by (temporarily) moving the counter knife 22 out of the cutting position. The cutting knives 23, 24 can thereby be moved past the stationary web of material 12, without a severing cut being made.

Figure 2:
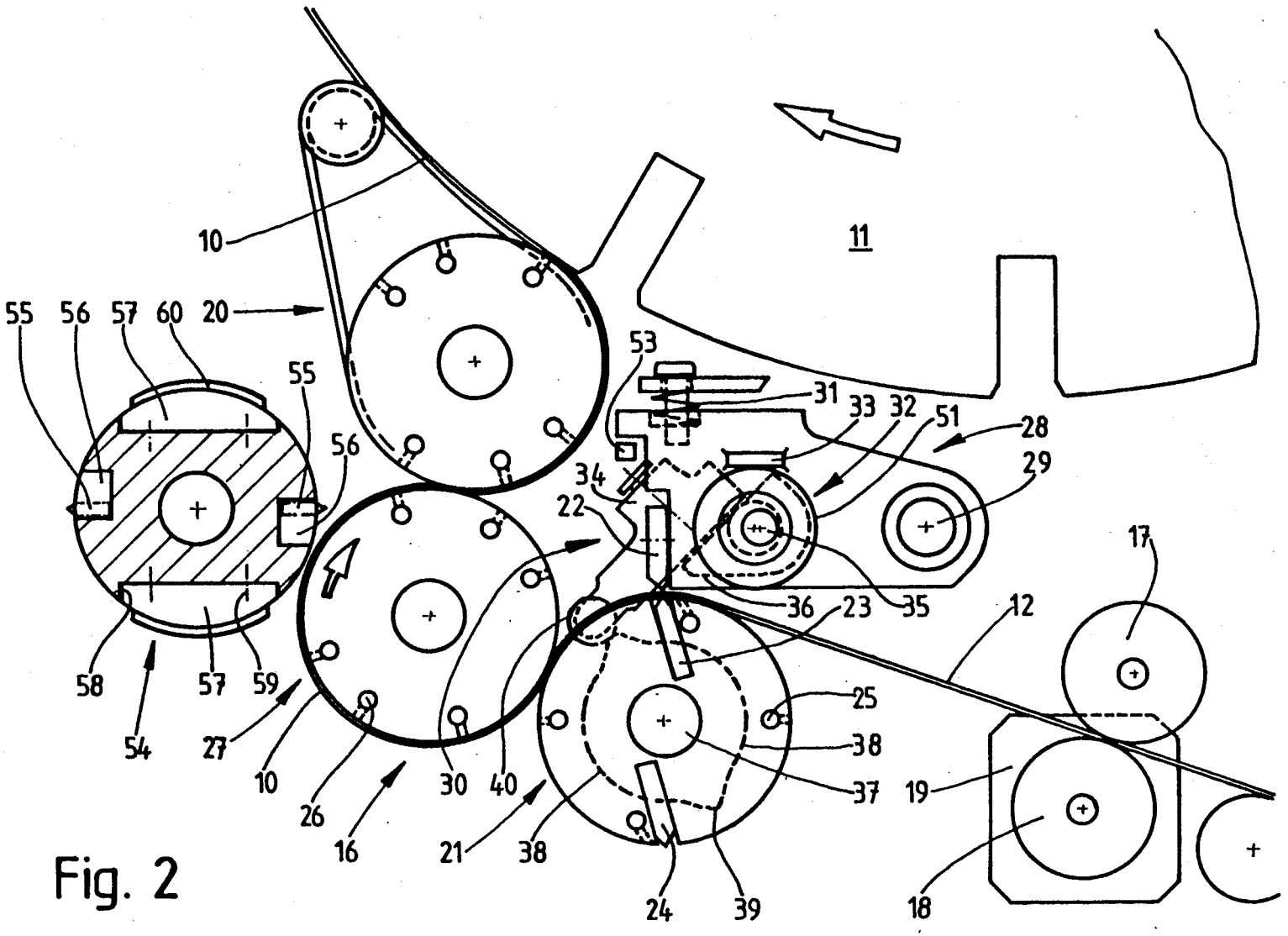
FIG. 2 shows details of the apparatus according to FIG. 1 on an enlarged scale.

For this purpose, the counter knife 22 is attached to a supporting arm 28 which is pivotable about a rotary bearing 29 distant from the counter knife 22. By means of an actuating member 30, the supporting arm 28 is pivoted, in the clockwise direction in the representation in FIGS. 1 and 2, in order to lift the counter knife 22 off from the cutting position. These stroke movements of the counter knife 22 with the supporting arm 28 take place counter to the load of a highly prestressed compression spring 31, by which the supporting arm 28 and consequently the counter knife 22 are loaded in the direction of the cutting position. To interrupt the cutting function, it is sufficient if the counter knife 22 executes small stroke movements, specifically intermittently, in particular each time during the movement of the cutting knife 23 or 24 past the counter knife 22. The supporting arm 28 or the counter knife 22 are accordingly shifted intermittently, specifically under the control of the rotational movement of the knife roller 21. The counter knife 22 accordingly executes pulsating stroke movements.

In the present exemplary embodiment, the adjusting member 30 does not act directly on the supporting arm 28, but via an intermediate mechanism which, here, is designed as an eccentric mechanism 32. This is likewise driven in a pulsatory or oscillatory manner. The adjusting movements generated thereby are transmitted to the supporting arm 28 via a stop piece 33.

In the present exemplary embodiment, the adjusting member 30 is designed as an adjusting lever 34. This is connected to a rotary journal 35 of the eccentric mechanism 32, in such a way that, during a pivoting movement of the adjusting lever 34, the rotary journal 35 and, via this, the eccentric mechanism 32 is adjusted with the effect of a stroke movement of the supporting arm 28. For this purpose, a transversely directed pivoting lever 36 is attached to the free end of the rotary journal 35. The adjusting lever 34 is connected to this pivoting lever 36 eccentrically relative to the rotary journal 35, in such a way that pivoting movements of the adjusting lever 34 trigger corresponding movements of the pivoting lever 36 which are transmitted to the rotary journal 35.

The movements of the adjusting lever 34 are controlled by the rotational movement of the knife roller 21. Mounted corotationally on a shaft 37 for the drive of the knife roller 21 is a cam disc 38. This is designed with adjusting bosses 39 in the region of the cutting knives 23, 24. A tracer roller 40 on the free end of the adjusting lever 34 runs on the circumference of the cam disc. In the region of the adjusting bosses 39, pivoting movements of the adjusting lever 34 are generated in such a way that the counter knife 22 is briefly moved out of the cutting position.

When the apparatus is operating without fault, the adjusting device for the counter knife 22 is inactive. For this purpose, in the present exemplary embodiment the adjusting lever 34 or its tracer roller 40 is movable out of engagement with the cam disc 38. The adjusting lever 34 is consequently (additionally) pivotable in a transversely directed plane, particularly about a pivot bearing 41. This is formed by a bearing journal 42, by means of which the adjusting lever 34 is at the same time fastened to the pivoting lever 36.

At the end remote from the tracer roller 40, the adjusting lever 34 is equipped with a laterally directed extension 43, on which an actuating member for pivoting the adjusting lever 34 about the pivot bearing 41 engages. In the present case, the actuating member is an actuating cylinder 44 which is mounted in an articulated manner at a fixed location (machine stand 45) and the piston rod of which is connected pivotably to the extension 43 of the adjusting lever 34. Here, the extension 43 is equipped with a connecting pin 46, on which the end of the piston rod is mounted rotatably.

Figure 3:
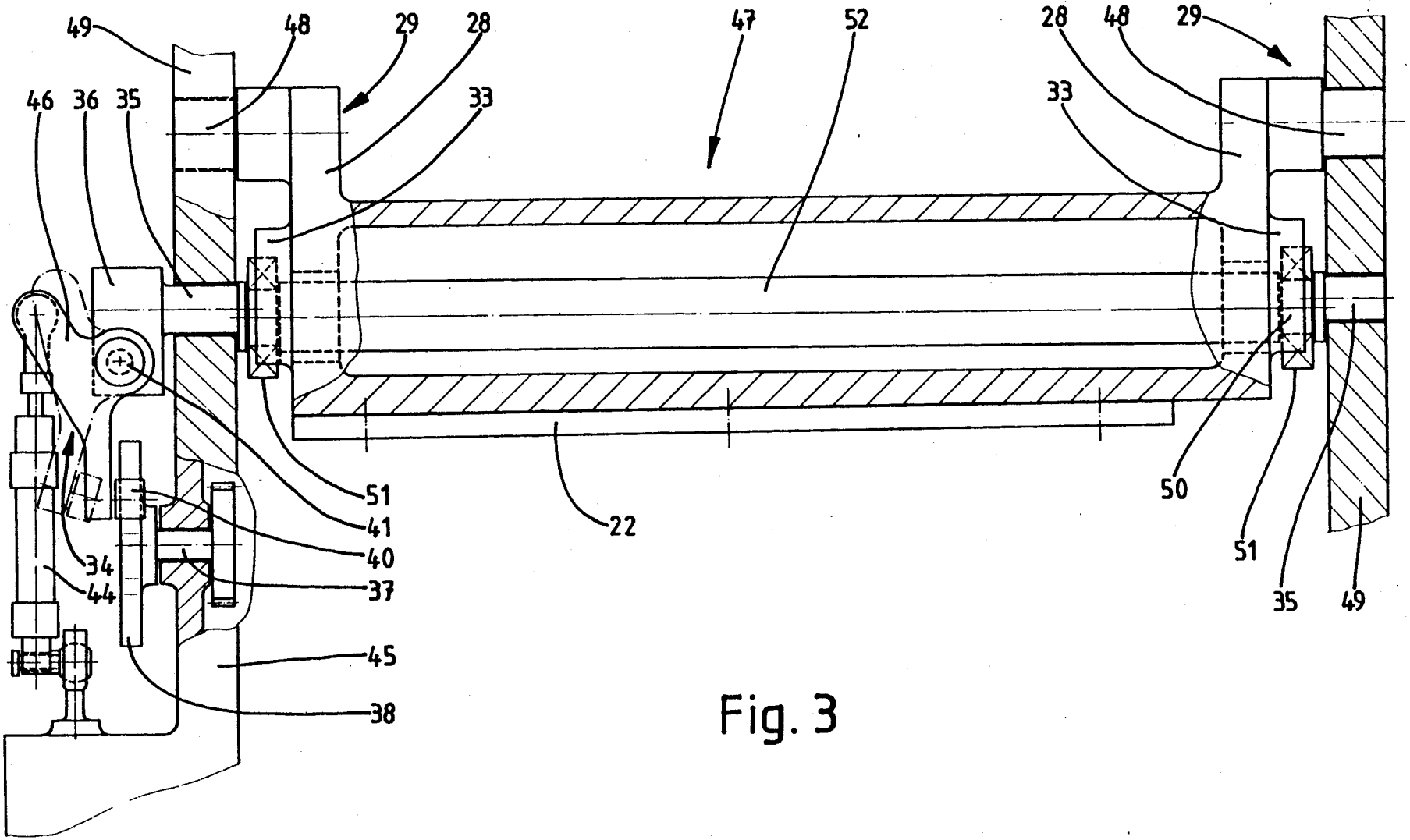
FIG. 3 shows a transverse axial view of a detail of the apparatus according to FIGS. 1 and 2, particularly a counter knife, partially in longitudinal section.
Figure 4:
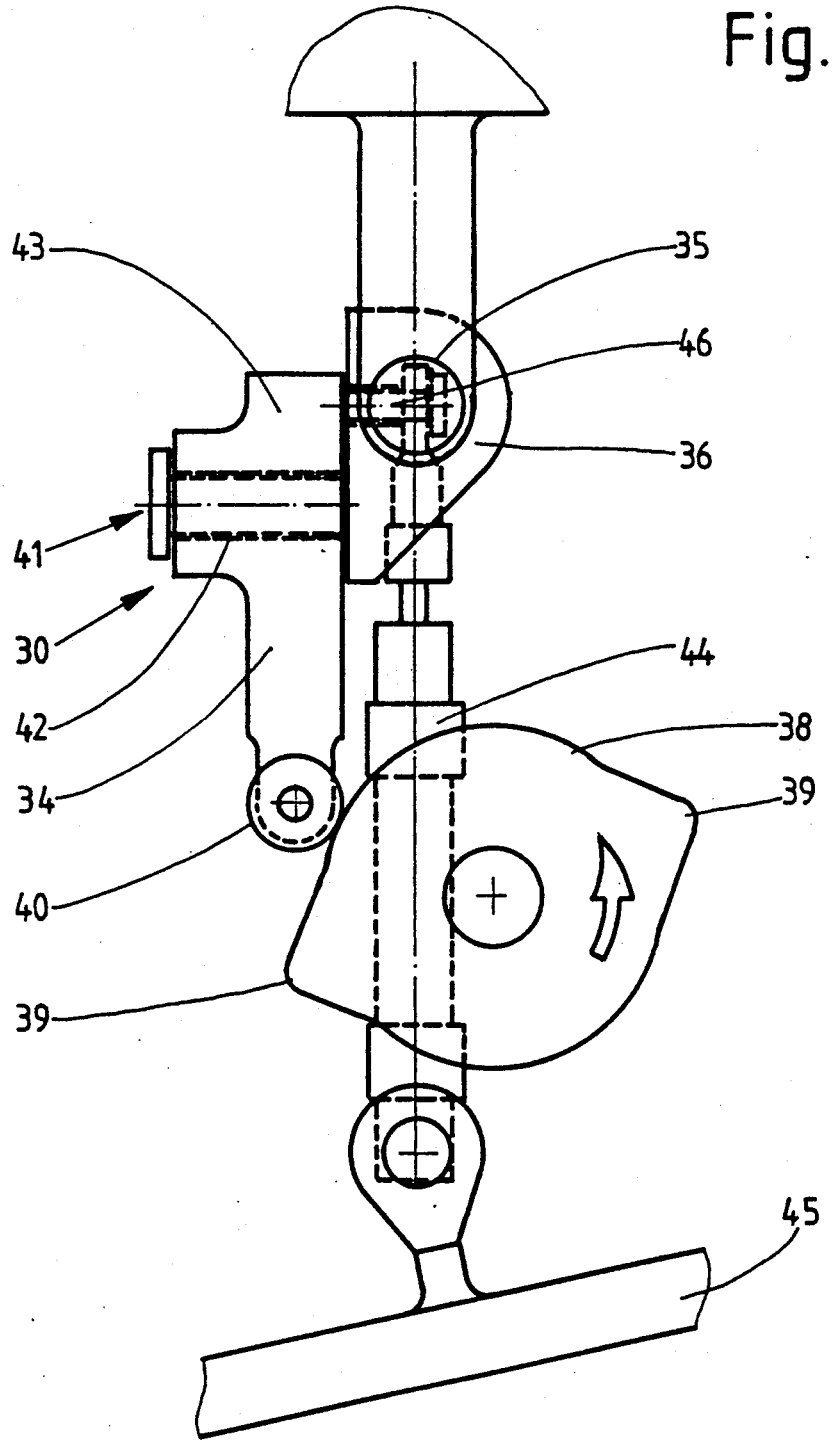
FIG. 4 shows details of an adjusting mechanism for the counter knife in a view offset 90° relative to FIG. 3.

When there is an interruption in the feed of articles to be wrapped, the actuating cylinder 44 is set in motion by means of an appropriate signal, in such a way that the adjusting lever 34 is pivoted out of the initial position represented by dot-and-dash lines in FIG. 3 into the actuating position shown by unbroken lines. In this, the tracer roller rests against the circumference of the cam disc 38 and transmits the adjusting movements described to the eccentric mechanism 32. When the feed of articles to be wrapped resumes, the adjusting lever 34 is once again pivoted out of engagement with the cam disc 38. The counter knife 22 is thereby positioned uninterruptedly in the cutting position.

For the exact mounting of the elongate counter knife 22, two supporting arms 28 are arranged at a distance from one another and are connected to one another by means of a load-bearing crossmember 47. The crossmember 47 is designed as a hollow body. The counter knife 22 is attached externally on one side of this. To form the equiaxial rotary bearings 29, the supporting arms 28 are each mounted by means of a rotary journal 48 in a stationary cheek 49 of the machine stand 45. The eccentric mechanisms 32 assigned to the two supporting arms 28 are of identical design and are connected to one another. An eccentric journal 50 is attached in an offset manner to each of the rotary journals 35. Arranged on this eccentric journal 50 is a ball-bearing ring 51 which, during rotations of the rotary journals, is moved up and down and transmits the stroke movements to the stop pieces 33.

The eccentric journals 50 of the two eccentric mechanisms 32 are connected to one another by means of a connecting shaft 52. This extends within the hollow crossmember 47 and serves for transmitting the pivoting movements of the drive (pivoting lever 36) arranged only on one side to the opposite eccentric mechanism 32. In this, the rotary journal 35 is mounted rotatably in the cheek 49.

Very accurate small stroke movements of the two supporting arms 28 and consequently of the counter knife 22 can be executed by means of the mechanism so designed. In the present example, the exact cutting position is guaranteed by a stationary stay stop 53, against which the supporting arm 28 comes to bear by means of a projection under the load of the compression spring 31.

The severed blanks 10 are transferred by the knife roller 21 designed as a conveyor roller to the intermediate conveyor roller 27. In the region of the latter, a punching roller 54 is activated, and by means of this punchings or perforations are made in the blanks 10, for example for an opening tab.

The punching roller 54 can be equipped with approximately radially directed knives 55 which are attached removably in a recess 56 of sufficient size of the punching roller 54. The arrangement is such that it is possible for the knives 55 to be exchanged easily.

Figure 5:
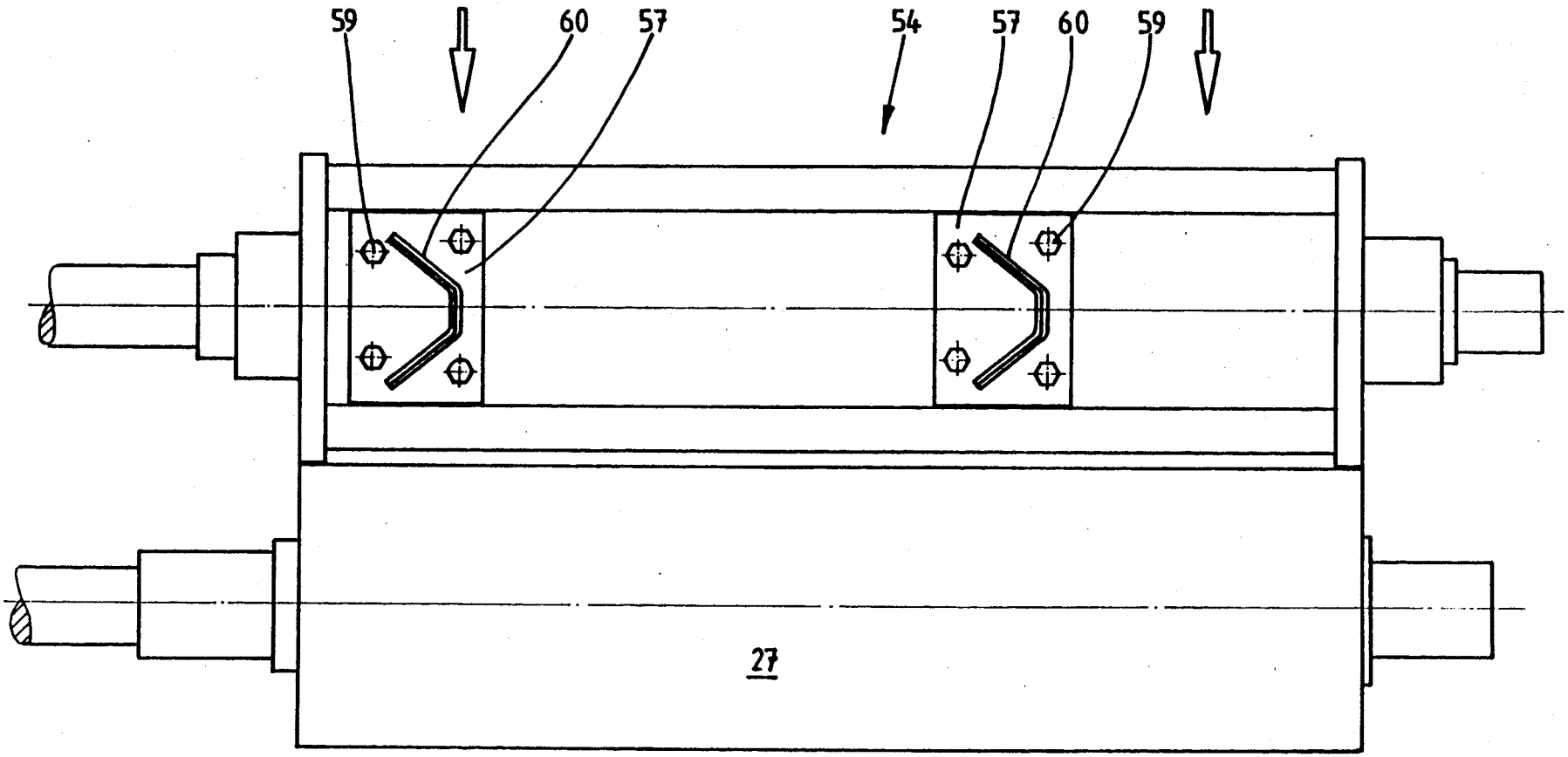
FIG. 5 shows a longitudinal view of further details of the apparatus, namely a perforating roller with a backing roller.

Additionally or alternatively, punching knives 57 can be attached to the punching roller 54, specifically likewise in an appropriate depression 58. These punching knives 57 extend along a part circumference of the punching roller 54 and are intended for producing complex perforations or cutting patterns in the blank 10. In the exemplary embodiment illustrated in FIG. 5, two punching knives 57 of this type arranged at a distance from one another are fastened in the axial direction releasably, particularly by means of screws 59. The actual punching tool or a punching edge 60 is made in the form of a truncated V, in order to produce a corresponding perforated punching in the blank 10. The arrangement of two of these tools on the common punching roller 54 serves for operating the apparatus in the dual mode. The latter is accordingly organized so that a web of material of double width or two webs of material, each corresponding to the width of a blank 10, are fed to the severing station 16 and that two blanks 10 are accordingly produced simultaneously and fed to the folding turret 11.

What is claimed is:

1. An apparatus for feeding blanks of packaging material to a folding turret for wrapping groups of articles, comprising:

(a) a blank severing station including a continuously rotatably driven cylindrical roller (21) mounting a pair of diametrically opposite cutting knives (23, 24), and a reciprocable counter knife (22) disposed for interaction with the cutting knives, (b) means for feeding a web (12) of packaging material to the severing station, (c) means for feeding blanks (10) severed from the web at the severing station to the folding turret, and (d) means responsive to an interruption of a supply of articles to be wrapped for intermittently moving the counter knife away from the roller in a cyclical manner, each time a cutting knife approaches and passes the counter knife, such that an end portion of the web is retained at the severing station, with the rotating cutting knives passing therealong, in position for an immediate resumption of blank severing and feeding operations upon a resumption of the supply of the articles.

2. Apparatus according to claim 1, wherein the actuating mechanism has an adjusting lever (34) via which movements transmitted to the counter knife (22) are derivable from the roller (21), through a follower roller (4) bearing against the cam disc (38).

3. Apparatus according to claim 2, wherein, during the severing of blanks (10), the adjusting lever (34) is pivoted out of engagement with the cam disc (38).

4. Apparatus according to claim 3, wherein the adjusting lever (34) is pivotable in a plane transverse to the plane of the cam disc (38), especially by means of an actuating cylinder (44), at the same time executing a rotational movement about a pivot bearing (41) having a transversely directed axis of rotation.

5. Apparatus according to claim 2 wherein, in order to interrupt the severing operation, the counter knife (22) is movable out of the cutting position in a pulsatory manner by means of an eccentric mechanism (32).

6. Apparatus according to claim 5, wherein the eccentric mechanism (32) is driven in a pulsatory manner by the adjusting lever (34).

7. Apparatus according to claim 6, wherein the adjusting lever (34) is connected to an actuating member for the eccentric mechanism (32), via a pivoting lever (36) with an eccentric rotary journal (35).

8. Apparatus according to claim 7, wherein the rotary journal (35) is connected in an axisparallel offset manner to an eccentric journal (50) which is mounted in a rotary ring (51) for transmitting stroke movements to the counter knife (22).

9. Apparatus according to claim 5 wherein the counter knife is mounted on a pivotable supporting arm (28) which is pivotable about a rotary bearing (29) for moving the counter knife (22) out of the cutting position, by means of the eccentric mechanism (32).

10. Apparatus according to claim 8 wherein the counter knife (22) is held by two supporting arms (28) which are arranged at a distance from one another, and which, by means of a transverse girder (cross-member 47), are connected to one another and are jointly movable.

11. Apparatus according to claim 1, wherein an intermediate conveyor roller (27) adjacent to the knife roller (21) is associated with a punching roller (54) for making punchings and perforations in a blank, the punching roller (54) having releasably attached punching tools.

* * * * *